US012138558B2

(12) United States Patent
Abdullah et al.

(10) Patent No.: US 12,138,558 B2
(45) Date of Patent: Nov. 12, 2024

(54) AMUSEMENT RIDE FOR CHILDREN

(71) Applicant: KUWAIT UNIVERSITY, Safat (KW)

(72) Inventors: Abdullah Mohammed Abdullah, Safat (KW); Asmaa Saad Alenezi, Safat (KW); Ameenah Mohammed Alawadhi, Safat (KW); Munira Abdullah Alghannam, Safat (KW); Shaikha Khaled Almasoud, Safat (KW)

(73) Assignee: KUWAIT UNIVERSITY, Safat (KW)

( * ) Notice: Subject to any disclaimer, the term of this patent is extended or adjusted under 35 U.S.C. 154(b) by 766 days.

(21) Appl. No.: 17/362,158

(22) Filed: Jun. 29, 2021

(65) Prior Publication Data

US 2022/0410019 A1 Dec. 29, 2022

(51) Int. Cl.

| | |
|---|---|
| ***A63G 9/16*** | (2006.01) |
| ***A63G 9/02*** | (2006.01) |
| ***A63G 9/04*** | (2006.01) |
| ***A63G 27/00*** | (2006.01) |

(52) U.S. Cl.

CPC ..... *A63G 9/16* (2013.01); *A63G 9/02* (2013.01); *A63G 9/04* (2013.01); *A63G 27/00* (2013.01)

(58) Field of Classification Search

CPC ... A63G 9/02; A63G 9/04; A63G 9/16; A63G 27/00

See application file for complete search history.

(56) References Cited

U.S. PATENT DOCUMENTS

| | | | | |
|---|---|---|---|---|
| 1,548,535 A * | 8/1925 | John | ..... | A63G 9/04 104/81 |
| 2,448,325 A * | 8/1948 | Poorman, Jr. | ..... | A63G 9/04 104/81 |
| 2,992,835 A | 7/1961 | Lew'chuk | | |

(Continued)

FOREIGN PATENT DOCUMENTS

| | | |
|---|---|---|
| DE | 3938318 A1 | 5/1990 |
| KR | 20160045211 A | 4/2016 |

OTHER PUBLICATIONS

"The Tea Cup Ride", Mack Rides (2017), https://mack-rides.com/products/spin-rides/teacup-ride/, printed on Jan. 4, 2021.

*Primary Examiner* — Scott A Browne
(74) *Attorney, Agent, or Firm* — Nath, Goldberg & Meyer; Joshua B. Goldberg

(57) ABSTRACT

The amusement ride for children has an open frame and a swinging passenger carriage suspended from a crossbar carried by two trolleys mounted in parallel tracks on the roof of the open frame. The passenger carriage has an upper platform rotatably mounted on a base platform, rotation of the upper platform being controlled manually by the passenger through rotation of a wheel mounted on a column having an end journaled into a bearing mounted in the base platform. A reversible motor is mounted on the roof frame, the shaft of the motor being connected to the crossbar by a crank and connecting rod to control translational movement of the trolleys, causing the passenger carriage to swing forward and backward. The combination of translational movement and swinging movement of the carriage with rotational movement of the upper platform provides a uniquely thrilling sensation for a child seated on the passenger carriage.

13 Claims, 7 Drawing Sheets

(56) References Cited

U.S. PATENT DOCUMENTS

| | | | | | |
|---|---|---|---|---|---|
| 3,692,305 | A * | 9/1972 | Allen | A63G 9/16 | 472/119 |
| 4,190,248 | A * | 2/1980 | Philippi | A63G 9/04 | 472/120 |
| 4,323,233 | A * | 4/1982 | Gebhard | A47D 13/105 | 185/5 |
| 5,833,545 | A * | 11/1998 | Pinch | A47D 9/057 | 472/119 |
| 6,361,446 | B2 * | 3/2002 | Lawson | A47C 17/84 | 472/125 |
| 8,574,088 | B1 * | 11/2013 | Burriss | A63G 1/14 | 472/125 |
| 2011/0059806 | A1 * | 3/2011 | Qiu | A47C 3/0255 | 472/119 |
| 2013/0310187 | A1 * | 11/2013 | Rogers | A63G 9/16 | 472/119 |
| 2014/0261051 | A1 | 9/2014 | Kitchen | | |
| 2015/0051005 | A1 | 2/2015 | Checketts | | |
| 2015/0051006 | A1 | 2/2015 | Checketts | | |

* cited by examiner

AMUSEMENT RIDE FOR CHILDREN

BACKGROUND

1. Field

The disclosure of the present patent application relates to amusement devices, and particularly to an amusement ride for children.

2. Description of the Related Art

Amusement parks, carnivals, and similar entertainment venues frequently provide rides as an amusing diversion for children visiting the site. Amusement rides having carriers that swing back and forth while being elevated above the ground are popular, providing the thrilling sensation of an often open enclosure swinging upward towards the sky and then falling downward under the accelerating force of gravity, only to swing upward in the reverse direction, repeating the cycle against the sweeping panorama of the surrounding landscape. Nevertheless, space limitations at many such venues require that these rides have a small footprint, so that the limited sweep of the ride produces a corresponding reduction in the thrill provided by the ride. It has been hypothesized that adding an additional axis of movement to the gondola or passenger carriage would increase the thrill level and add excitement to the ride to maintain interest in the amusement ride. Thus, an amusement ride for children solving the aforementioned problems is desired.

SUMMARY

The amusement ride for children has an open frame and a swinging passenger carriage suspended from a crossbar carried by two trolleys mounted in parallel tracks on the roof of the open frame. The passenger carriage has an upper platform rotatably mounted on a base platform, rotation of the upper platform being controlled manually by the passenger through rotation of a wheel mounted on a column having an end journaled into a bearing mounted in the base platform. A reversible motor is mounted on the roof frame, the shaft of the motor being connected to the crossbar by a crank and connecting rod to control translational movement of the trolleys, causing the passenger carriage to swing forward and backward. The combination of translational movement and swinging movement of the carriage with rotational movement of the upper platform provides a uniquely thrilling sensation for a child seated on the passenger carriage.

The open frame includes a rectangular base frame, which may have a floor; a rectangular roof frame having two elongated side rails, two end beams, and a center joist extending between the side rails and defining a trolley half and a drive half; and four corner posts joining the base frame and the roof frame. Two parallel channels extend between the end beam and the center joist in the trolley half, defining the parallel tracks. The two trolleys, mounted on wheels, are mounted in the tracks for translational movement, the trolleys supporting the crossbar. A carriage supporting link is rotatably mounted on opposite ends of the crossbar, respectively. The passenger carriage is mounted between the two links so that the carriage swings back and forth with translational movement of the trolleys.

These and other features of the present subject matter will become readily apparent upon further review of the following specification.

BRIEF DESCRIPTION OF THE DRAWINGS

Similar reference characters denote corresponding features consistently throughout the attached drawings.

DETAILED DESCRIPTION OF THE PREFERRED EMBODIMENTS

The amusement ride for children has an open frame and a swinging passenger carriage suspended from a crossbar carried by two trolleys mounted in parallel tracks on the roof of the open frame. The passenger carriage has an upper platform rotatably mounted on a base platform, rotation of the upper platform being controlled manually by the passenger through rotation of a wheel mounted on a column having an end journaled into a bearing mounted in the base platform. A motor is mounted on the roof frame, the shaft of the motor being connected to the crossbar by a crank and connecting rod to control translational movement of the trolleys, causing the passenger carriage to swing forward and backward. The combination of translational movement and swinging movement of the carriage with rotational movement of the upper platform provides a uniquely thrilling sensation for a child seated on the passenger carriage.

The open frame includes a rectangular base frame, which may have a floor; a rectangular roof frame having two elongated side rails, two end beams, and a center joist extending between the side rails and defining a trolley half and a drive half; and four corner posts joining the base frame and the roof frame. Two parallel channels extend between the end beam and the center joist in the trolley half, defining the parallel tracks. The two trolleys, mounted on wheels, are mounted in the tracks for translational movement, the trolleys supporting the crossbar. A carriage supporting link is rotatably mounted on opposite ends of the crossbar, respectively. The passenger carriage is mounted between the two links so that the carriage swings back and forth with translational movement of the trolleys.

Figure 1A:
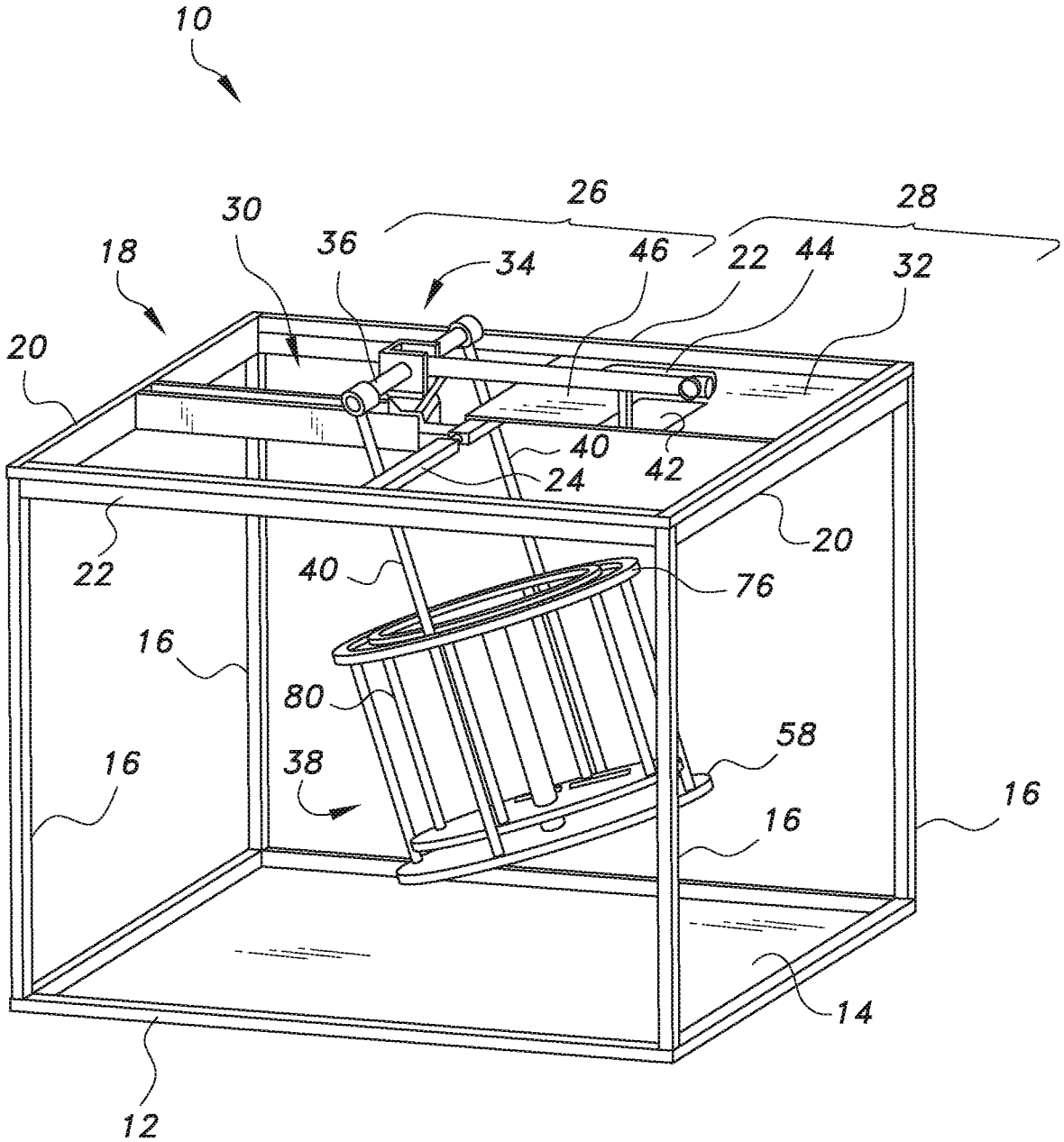
FIG. 1A is a perspective view of an amusement ride for children, shown with the crank in the 3:00 o'clock position, the motor and the passenger seat(s) being omitted for clarity.

As shown in FIG. 1A, the amusement ride for children, designated generally as 10 in the drawings, has a rectangular base frame 12. which may include a floor 14. Four posts 16 extend vertically from the corners of the rectangular base frame 12. The posts 16 support a rectangular roof frame 18, which includes two parallel end beams 20 and two parallel side rails 22 extending between the end beams 20. A center joist 24 extends between the side rails 22 parallel to the end beams 20, dividing the roof frame 18 into a trolley half 26 and a drive half 28. A track structure 30 extends between the end beam 20 and the center joist 24 in the trolley half 26 of the roof frame 18, and a motor platform 32 is mounted in the drive half 28 of the roof frame 18.

A trolley assembly 34 is mounted in the track structure 30 and is constrained to translational movement between the end beam 20 and the center joist 24 above the trolley half 26 of the rectangular roof frame 18. The trolley assembly 34 includes a crossbar 36 extending laterally between and above the sides of the rectangular roof frame 18. A passenger carriage 38 is suspended from the trolley assembly 34 by two elongated links 40, the links 40 being rotatably mounted at opposite ends, respectively, of the crossbar 36 by suitable roller bearing assemblies or the like so that inertia causes the passenger carriage 38 to swing outward and upward when the trolley assembly 34 reaches the respective ends of the track structure 30 and reverses direction, swinging in a pendulum motion as the trolley assembly 34 engages in reciprocating translational movement.

The trolley assembly 34 is actuated to engage in translational movement by a motor (not shown in FIGS. 1A-1D; see FIG. 2) mounted on the motor platform 32 of the drive half 28 of the roof. The motor may be an electric motor or a gas-powered motor, and may be reversible, although rotation through 360° will drive the trolley assembly 34 to both ends of the track structure 30, so that one cycle will return the trolley assembly 34 to its starting point. The shaft of the motor is rotatably mounted in an opening formed through a support post 42 extending upward near an edge of the motor platform 32. A crank 44 is fixed to the shaft of the motor for rotation therewith. An elongate connecting rod 46 has one end pivotally attached to the crank 44 and the opposite end pivotally attached to the crossbar 36 mounted on the trolley assembly 34.

Figure 1B:
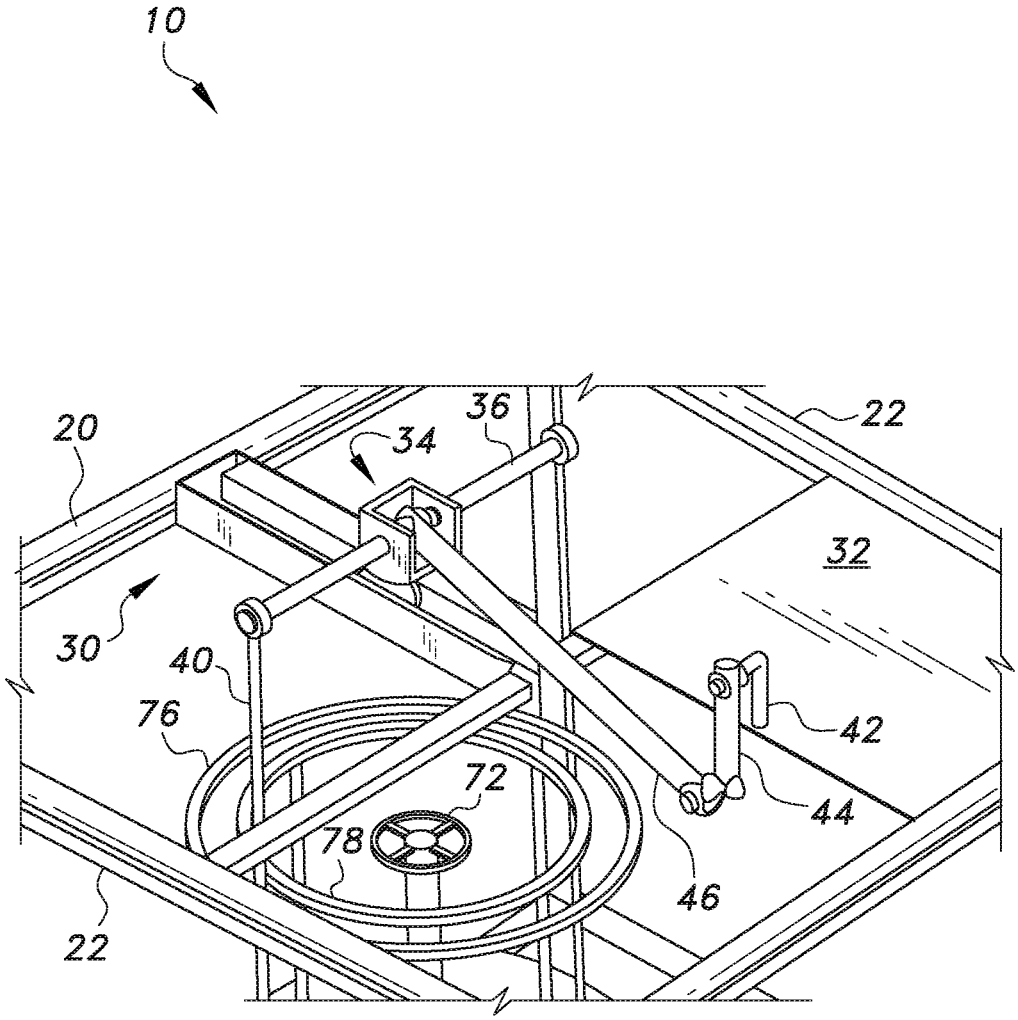
FIG. 1B is a perspective view of an amusement ride for children, shown with the crank in the 6:00 o'clock position, the motor and the passenger seat(s) being omitted for clarity.
Figure 1C:
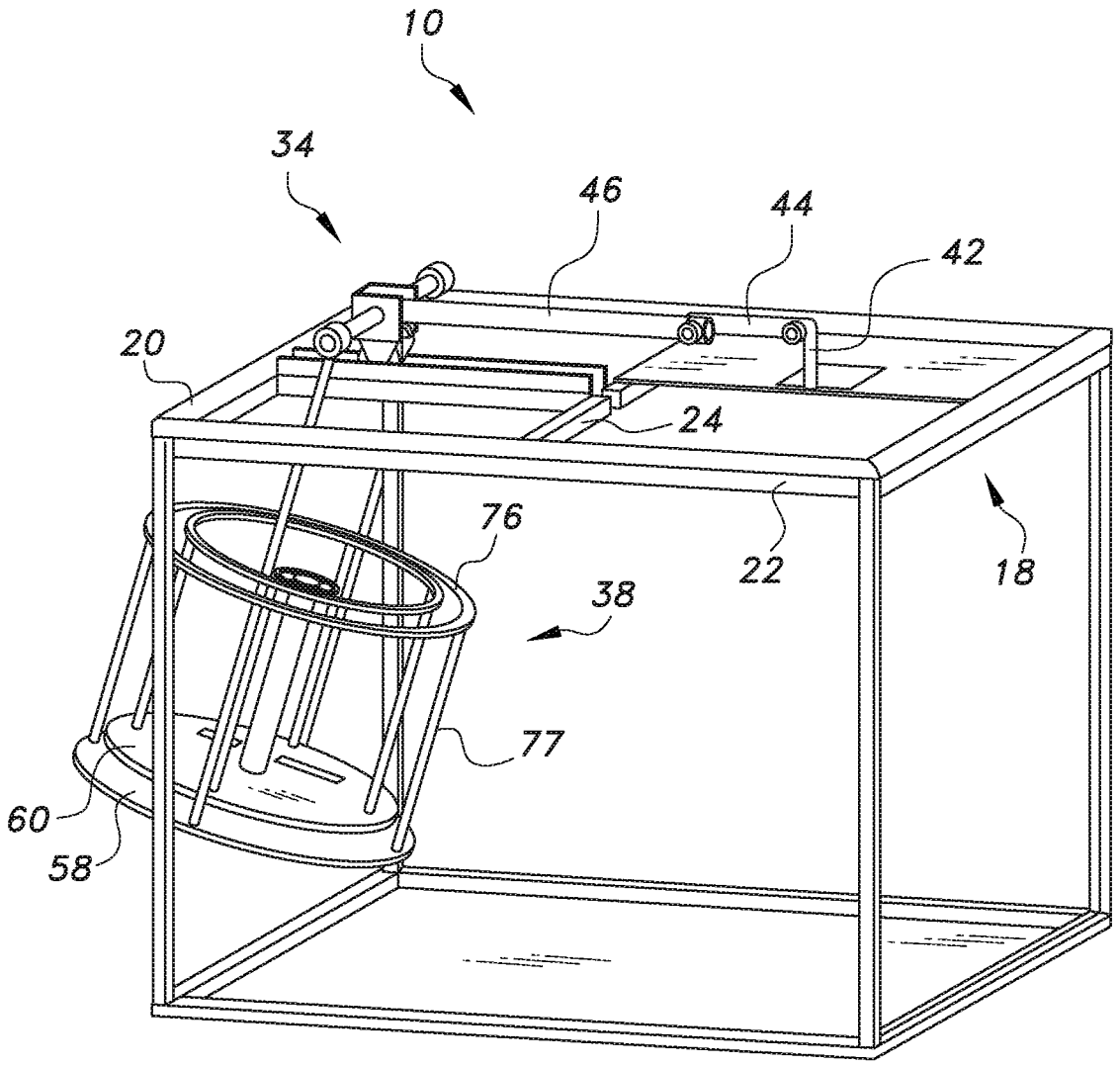
FIG. 1C is a perspective view of an amusement ride for children, shown with the crank in the 9:00 o'clock position, the motor and the passenger seat(s) being omitted for clarity.
Figure 1D:
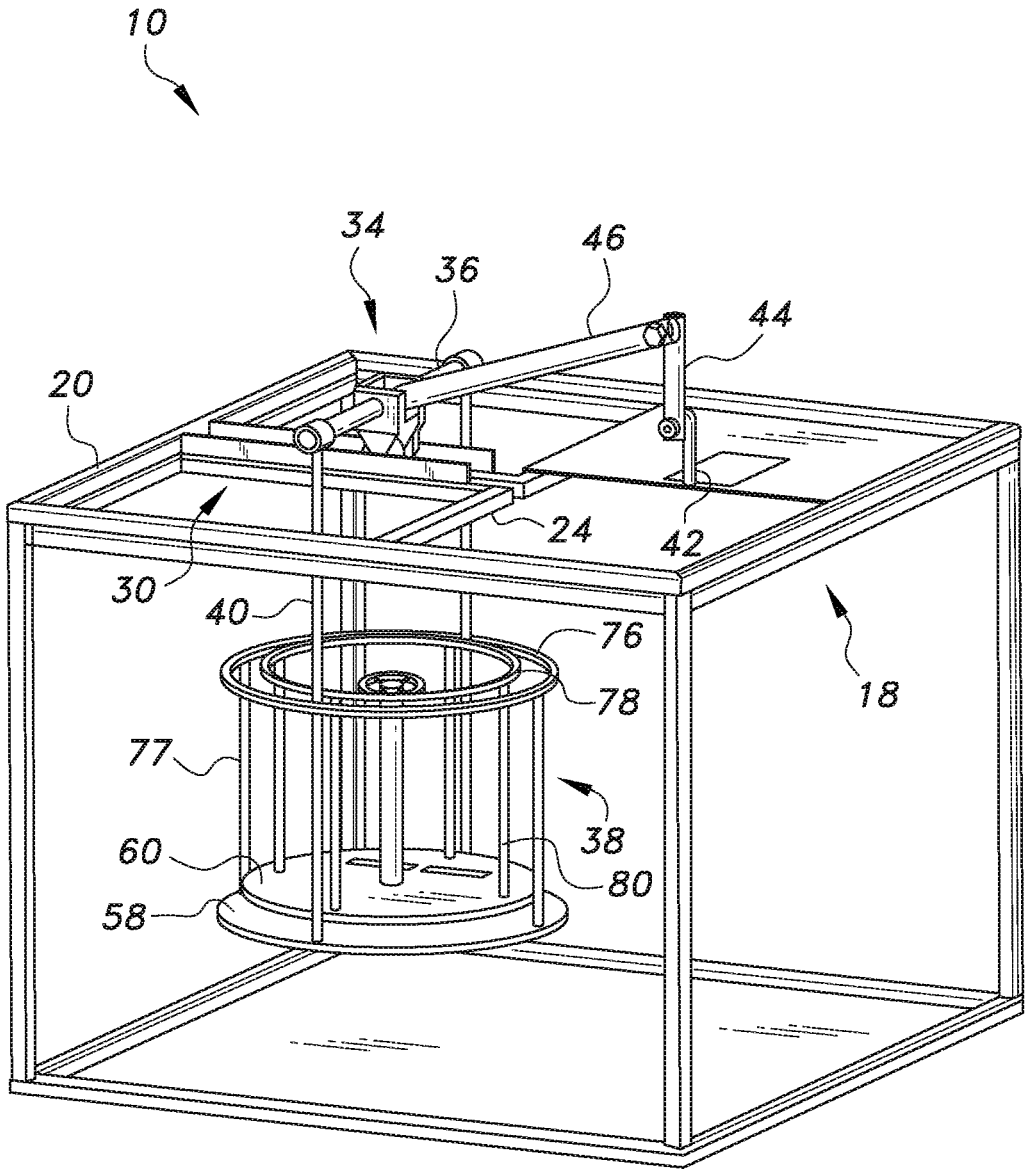
FIG. 1D is a perspective view of an amusement ride for children, shown with the crank in the 12:00 o'clock position, the motor and the passenger seat(s) being omitted for clarity.

As shown in FIG. 1A, when the crank 44 is rotated to the 3:00 o'clock position, or 0° (behind the connecting rod 44 in FIG. 1A), the trolley assembly 34 is drawn in the track structure 30 to the maximum extent of its travel towards the center joist 24. As shown in FIG. 1B, when the crank 44 is rotated to the 6:00 o'clock position, or −90° (extending downward through an open space in the rectangular roof frame 18 adjacent the motor platform 32), the trolley assembly 34 is translated in the track structure to a position approximately midway between the center joist 24 and the end beam 20 in the trolley half 26 of the roof frame 18. As shown in FIG. 1C, when the crank 44 is rotated to the 9:00 o'clock position, or 180°, the trolley assembly 34 is translated in the track structure to the maximum extent of its travel towards the end beam 20 in the trolley half 26 of the roof frame 18. Finally, as shown in FIG. 1D, when the crank 44 is rotated to the 12:00 o'clock position, or +90°, the trolley assembly 34 is translated back to a position approximately midway between the center joist 24 and the end beam 20 in the trolley half 26 of the roof frame 18.

Figure 2:
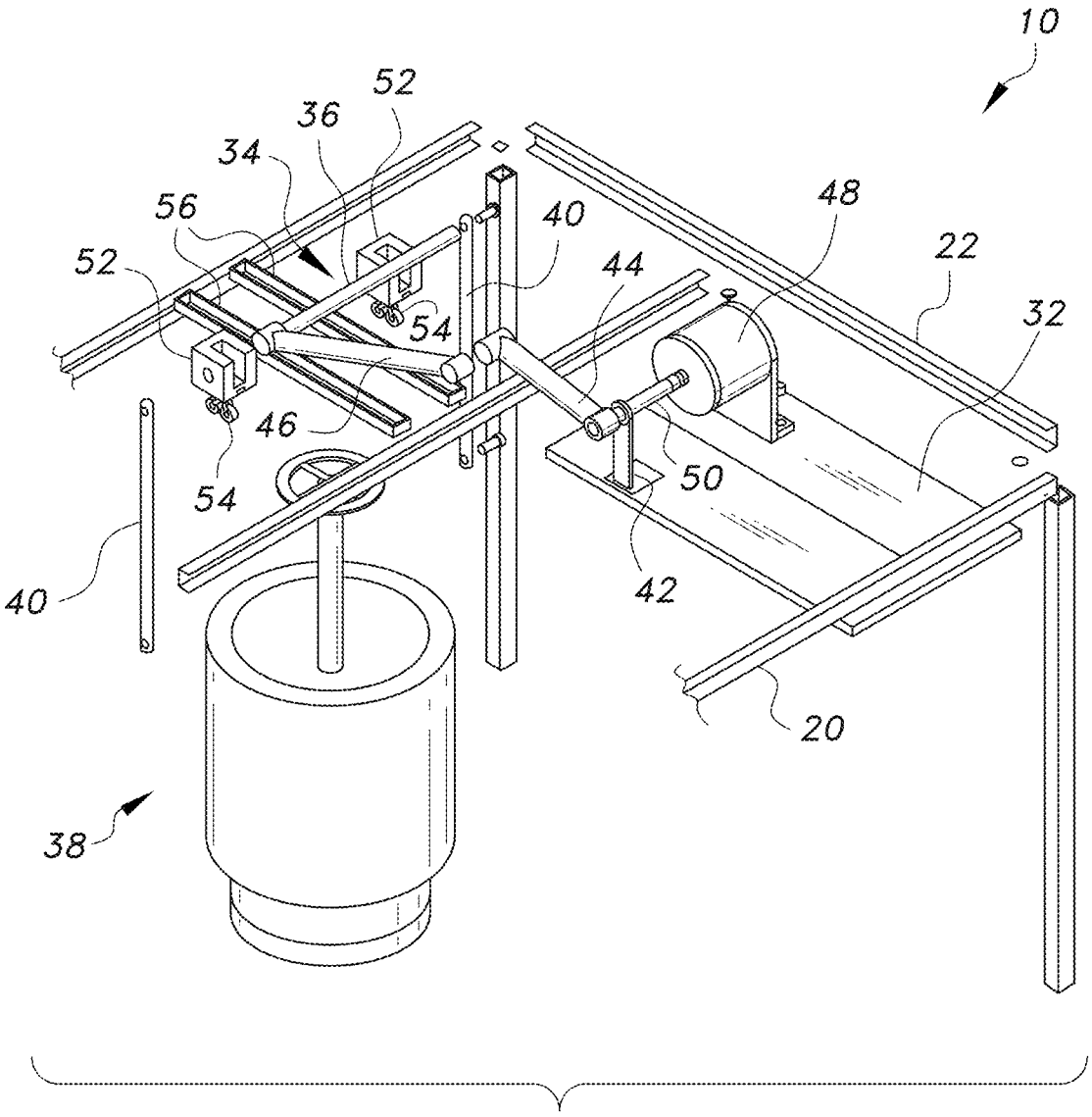
FIG. 2 is partial perspective view of the amusement ride for children, showing a portion of the roof supporting the motor and details of the trolley assembly.

As shown in FIG. 2, the motor 48 is mounted on the motor platform 32 in the drive half 28 of the roof frame 18. The motor shaft 50 is retained by the support post 42, through which the shaft 50 extends to connect with the crank 44. The trolley assembly 34 includes two trolleys 52, each trolley 52 being supported on wheels 54 or rollers. The track structure 30 includes two parallel U-shaped channels or tracks 56 extending between the center joist 24 and the end beam 20 in the trolley half 26 of the roof frame 18, the trolley wheels 54 being constrained to roll in the tracks 56. The trolleys 52 ae constrained to translate in unison in the tracks 56 by the crossbar 36 extending through the walls of the trolleys 52.

Figure 3A:
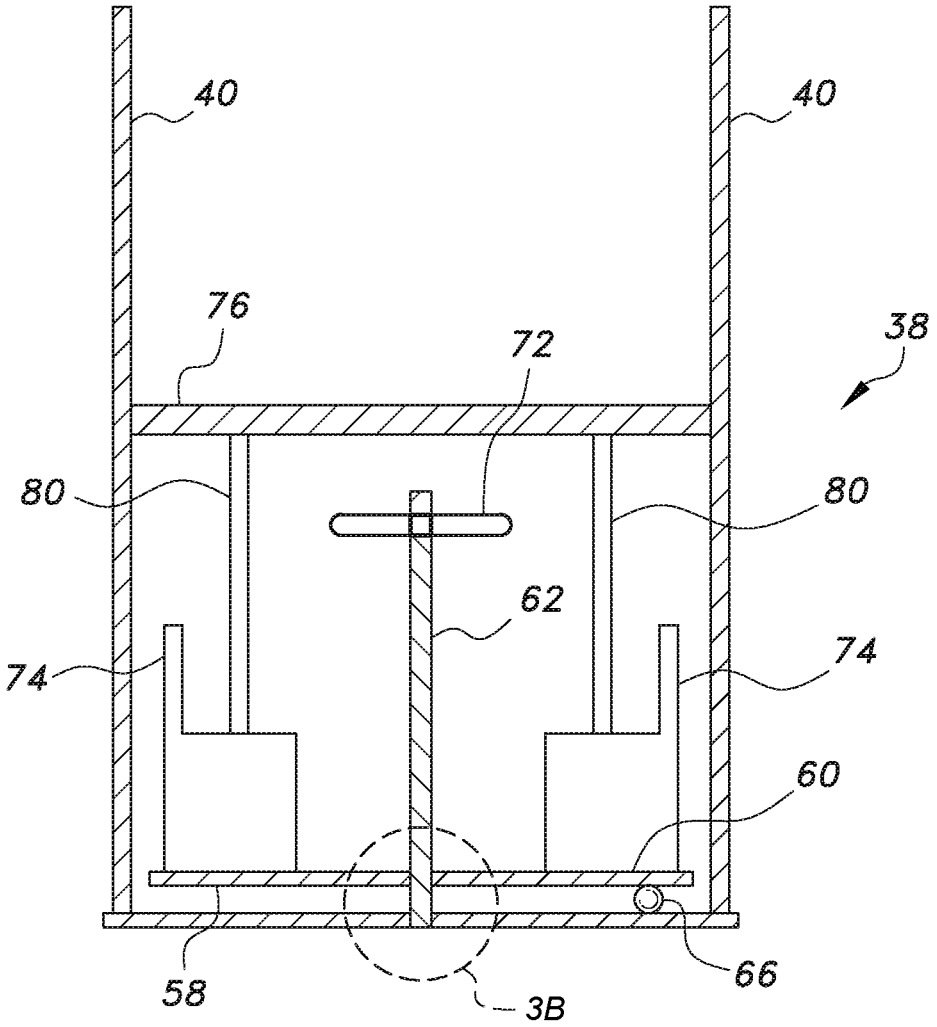
FIG. 3A is a diagrammatic side view of the passenger carriage of the amusement ride for children.
Figure 3B:
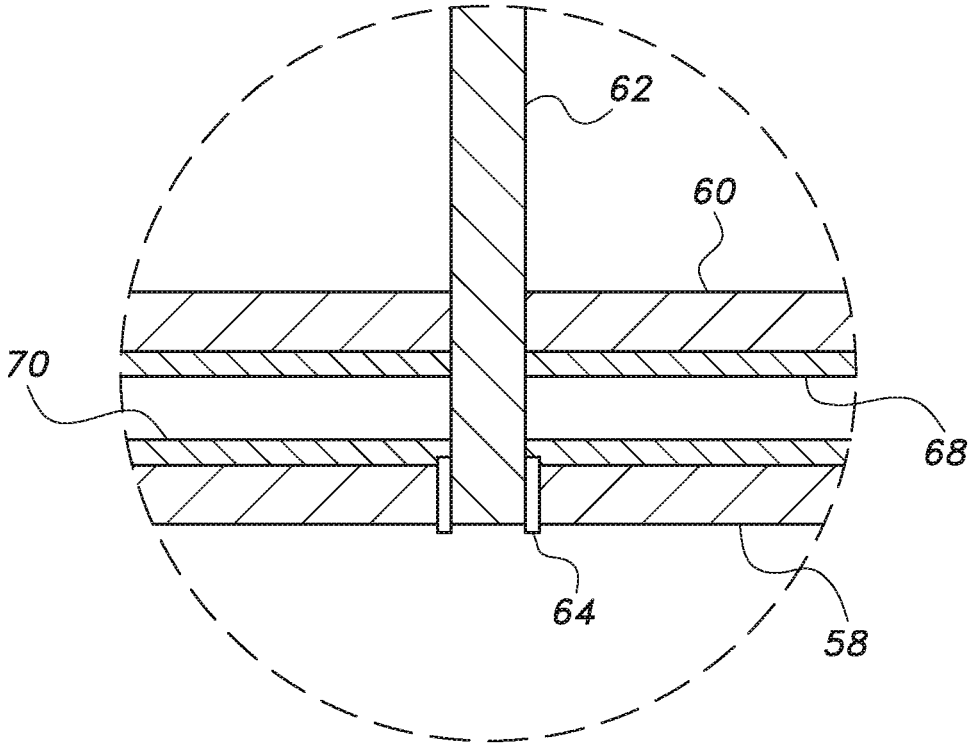
FIG. 3B is a detail view of area 3B of FIG. 3A, shown in section.

The passenger carriage 38 is shown in more detail in FIGS. 3A and 3B. The passenger carriage 38 has a circular base platform 58, the links 40 being rigidly attached to diametrically opposite positions near the perimeter of the base platform 58. A circular passenger platform 60 of smaller diameter than the base platform 58 is rotatably mounted above the base platform 58. A steering post or column 62 extends upward from the center of the passenger platform 60. The passenger platform 60 is rigidly attached to the steering post 62 for rotation therewith. The steering post 62 has a lower end extending below the passenger platform 60 that is journaled into a bearing 64 seated in the center of the base platform 58 to permit rotation of the steering post 62 and the attached passenger platform 60 relative to the base platform 58. In addition, there may be at least one ball bearing 66, roller bearing, or other suitable bearing disposed between the passenger platform 60 and the base platform 58 to reduce friction. The at least one ball bearing 66 may be incorporated into a Lazy Susan bearing having an upper bearing plate 68 attached to the passenger platform 60 and a lower bearing plate 70 attached to the base platform 58. The steering post 62 has an upper end having a wheel 72 attached thereto, which the child or the ride operator may turn to rotate the passenger platform 60 while the passenger carriage 38 is swinging during translational movement of the carriage 38 for an added thrill. One or more seats 74 may be mounted on the passenger platform 60 for the comfort of the children, the seats having a suitable safety belt, strap, or harness attached thereto. As shown in FIGS. 1A-1D, the passenger carriage 38 may also include an outer annular safety handrail 76 attached to the links 40 and posts 77 extending from the base platform 58, and an inner annular safety rail 78 attached to posts 80 mounted on the passenger platform 60.

Thus, the amusement ride operator may activate the motor 48 in forward and reverse directions to induce swinging motion of the passenger carriage 38 while simultaneously a rider may manually activate rotation of the passenger platform 60 to produce a combination of swinging and rotating sensations in the passenger(s).

It is to be understood that the amusement ride for children is not limited to the specific embodiments described above, but encompasses any and all embodiments within the scope of the generic language of the following claims enabled by the embodiments described herein, or otherwise shown in the drawings or described above in terms sufficient to enable one of ordinary skill in the art to make and use the claimed subject matter.

We claim:

1. An amusement ride for children, comprising:

a frame including a roof frame;

a track structure mounted on the roof frame;

a trolley assembly mounted on the track structure, the trolley assembly including an elongated crossbar having opposing ends;

a drive assembly mounted on the roof frame, the drive assembly including a prime mover having a rotatable shaft, a crank attached to the rotatable shaft, and a connecting rod having a first end pivotally attached to the crank and a second end attached to the crossbar, the prime mover being actuable to push and pull the trolley assembly in reciprocating translational movement in the track structure; and a passenger carriage suspended from the opposing ends of the crossbar and free to swing back and forth below the roof frame as the trolley assembly reciprocates in the track structure, the passenger carriage having a base platform and a passenger platform adapted for carrying children rotatably mounted above the base platform, the passenger platform being manually rotatable by a passenger while the passenger carriage is swinging to simultaneously induce swinging and rotating sensations in the children being carried in the passenger carriage.

2. The amusement ride according to claim 1, wherein said prime mover is a motor.

3. The amusement ride according to claim 2, wherein said motor is reversible.

4. The amusement ride according to claim 2, wherein said motor is an electric motor.

5. The amusement ride according to claim 2, wherein said motor is a gas-powered motor.

6. The amusement ride according to claim 1, wherein:

said frame further comprises a rectangular base frame having four corners and a corner post extending upward from each of the four corners of said base frame respectively, the roof frame being mounted on the corner posts; and the roof frame comprises:

two parallel end beams; two parallel side rails, the end beams and the side rails defining a rectangular perimeter of the roof frame;

a center joist parallel to the end beams, defining a trolley half and a drive half of the roof frame.

7. The amusement ride according to claim 6, wherein said track structure comprises two parallel U-shaped channels extending between the center joist and the end beam in the trolley half of said roof frame defining two parallel tracks, said trolley assembly comprising two trolleys, each of the trolleys having a body and at least one wheel, the body being mounted on the at least one wheel, the at least one wheel of each of the trolleys being constrained to translational movement in a corresponding one of the tracks, said crossbar extending through the body of both of the trolleys so that the two trolleys are constrained to translational movement in unison.

8. The amusement ride according to claim 7, wherein said roof frame further comprises a motor platform mounted in the drive half of said roof frame and a support post extending upward from the motor platform, said prime mover comprising a motor mounted on the motor platform, the motor having a motor shaft rotatable through 360°, the motor shaft being the rotatable shaft of the prime mover, the motor shaft being journaled through the support post, said crank having a first end fixed to the motor shaft for rotation of the crank through 360° and a second end pivotally attached to said connecting rod, whereby rotation of the motor shaft through one 360° cycle pushes and pulls the two trolleys through one cycle of reciprocating translational movement in the two parallel tracks.

9. The amusement ride according to claim 8, further comprising two elongated links, each of the links having a first end attached to the base platform of said passenger carriage and a second end pivotally attached to a corresponding one of the opposing ends of said crossbar, respectively, in order to suspend said passenger carriage from said trolley assembly and permit swinging movement of said passenger carriage as said trolley assembly engages in reciprocating translational movement.

10. The amusement ride according to claim 9, wherein said passenger carriage further comprises:

a steering post having an upper end and a lower end, the steering post extending upward from the passenger platform and having a wheel rigidly attached to the upper end, the passenger platform being rigidly attached to the steering post for rotation therewith;

a bearing mounted in the base platform, the lower end of the steering post being rotatably mounted in the bearing; and at least one ball bearing disposed between the passenger platform and the base platform, whereby an occupant of the passenger carriage may use the wheel at the upper end of the steering post to rotate the passenger platform relative to the base platform.

11. The amusement ride according to claim 10, wherein said passenger carriage further comprises another bearing having an upper plate attached to said passenger platform and a lower plate attached to said base platform, said at least one ball bearing comprising a plurality of ball bearings disposed between the upper plate and the lower plate.

12. The amusement ride according to claim 11, wherein said passenger carriage further comprises at least one seat mounted on said passenger platform.

13. The amusement ride according to claim 12, wherein said passenger carriage further comprises at least one annular safety rail mounted on said base platform and at least one annular safety rail mounted on said passenger platform.

* * * * *